US011912480B2

(12) United States Patent
Grobman

(10) Patent No.: US 11,912,480 B2
(45) Date of Patent: Feb. 27, 2024

(54) CONTAINER CAP FOR CONTROLLED MIXING AND DISPENSING

(71) Applicant: Katie Grobman, New York, NY (US)

(72) Inventor: Katie Grobman, New York, NY (US)

( * ) Notice: Subject to any disclaimer, the term of this patent is extended or adjusted under 35 U.S.C. 154(b) by 199 days.

(21) Appl. No.: 16/711,405

(22) Filed: Dec. 11, 2019

(65) Prior Publication Data

US 2020/0189815 A1 Jun. 18, 2020

Related U.S. Application Data

(60) Provisional application No. 62/778,836, filed on Dec. 12, 2018.

(51) Int. Cl.
*B65D 51/28* (2006.01)
*B65D 43/02* (2006.01)

(52) U.S. Cl.
CPC ..... *B65D 51/2885* (2013.01); *B65D 43/0231* (2013.01)

(58) Field of Classification Search
CPC ..... B65D 51/288; B65D 43/0231; B65D 51/2885; B65D 51/2814; B65D 51/2821; B65D 51/2807
USPC ..... 220/288
See application file for complete search history.

(56) References Cited

U.S. PATENT DOCUMENTS 3,603,469 A * 9/1971 Magni ..... B65D 81/3222 206/222
3,840,136 A * 10/1974 Lanfranconi ..... B65D 81/3222 215/6
5,950,819 A * 9/1999 Sellars ..... B65D 51/2885 206/221
6,766,903 B1 * 7/2004 Yehhsu ..... B65D 51/2821 206/222
7,325,676 B2 * 2/2008 Galaz Rodriguez ..... B65D 51/2814 206/219
7,503,453 B2 * 3/2009 Cronin ..... B65D 51/2892 206/221
7,588,142 B1 * 9/2009 Bush ..... B65D 51/2857 206/221
7,861,855 B2 * 1/2011 Casey ..... B65D 47/06 206/221
10,611,522 B2 * 4/2020 Rottman ..... B65D 51/2807
2003/0089627 A1 * 5/2003 Chelles ..... B65D 51/2835 206/219
2004/0149599 A1 * 8/2004 Cho ..... B65D 51/2892 206/219

(Continued)

FOREIGN PATENT DOCUMENTS

WO WO-2018138186 A1 * 8/2018 ..... B65D 25/00

*Primary Examiner* — Shawn M Braden
(74) *Attorney, Agent, or Firm* — Andres F. Arrubla

(57) ABSTRACT

Embodiments of the present disclosure include a cap for a container that incorporates a receptacle for an additive. The cap can enable separate transport of additives for the contents of the container in a sterile and convenient manner that enables mixing according to a user's preferences before the opening of the container and dispensing. According to some aspects, the configurable package can include pre-perforated portions to facilitate or allow a user to controllably mix and/or dispense additives onto the contents of the container. In some embodiments, an adaptor can be used to incorporate the described cap with existing bag or rigid disposable containers.

7 Claims, 5 Drawing Sheets

(56) References Cited

U.S. PATENT DOCUMENTS

| | | | | |
|---|---|---|---|---|
| 2004/0228208 | A1* | 11/2004 | Papania | B65D 51/2878 366/197 |
| 2007/0199838 | A1* | 8/2007 | Oh | B65D 51/28 206/219 |
| 2008/0023349 | A1* | 1/2008 | Balazik | B65D 51/28 206/222 |
| 2009/0139951 | A1* | 6/2009 | Chen | B65D 51/2835 215/227 |
| 2009/0180923 | A1* | 7/2009 | Gong | B65D 51/18 422/14 |
| 2009/0308831 | A1* | 12/2009 | Anderson | B65D 51/2807 215/227 |
| 2010/0157723 | A1* | 6/2010 | De La Vega | B65D 51/2885 366/162.2 |
| 2013/0313138 | A1* | 11/2013 | Thoman | B65D 51/2814 206/222 |
| 2018/0016069 | A1* | 1/2018 | Lanagan | B65D 51/2885 |
| 2019/0256262 | A1* | 8/2019 | Streisfeld | B65D 51/2821 |
| 2020/0002066 | A1* | 1/2020 | Guery | B65D 53/02 |
| 2020/0087041 | A1* | 3/2020 | Jang | B65D 51/2814 |

* cited by examiner

CONTAINER CAP FOR CONTROLLED MIXING AND DISPENSING

CROSS REFERENCE TO RELATED APPLICATION(S)

This present application claims priority to and incorporates by reference U.S. Provisional Application Ser. No. 62/778,836, filed on Dec. 12, 2018, entitled "A Container Cap System for Controlled Mixing and Dispensing".

FIELD OF THE INVENTION

This invention relates to the field of disposable packaging and more particularly to an improved cap that enables the inclusion of a separate receptacle for an additive as to enable controlled storing and mixing of contents prior to being dispensed.

BACKGROUND OF THE INVENTION

Widespread use of disposable packaging has been adopted in a variety of industries, including, for example, the food industry, cosmetics, household products, and personal care products. In some cases, and in the case of the packaging of condiments, the existing packaging design options have been driven by food preservation and only enable the user to select from separately packaged condiments he/she wants to add to the particular meal or drink. As a result, conventional disposable packaging solutions are typically limited to a single type of a condiment/solution/additive/component/mixture per package. Pre-mixed or pre-paired product package solutions of course don't allow the user/retailer to control ratios or to independently manage in accordance with individual component shelf life, and as a result, greater inventory and shelf space are needed for mixtures or pairings in order to cater to a wider range of consumers with different preferences. Single condiment/component/additive package solutions that enable a user to create his/her own mixture or pairing require individual packages which in many applications is unnecessarily wasteful and/or space consuming. In using a combination of existing single condiment/component/additive package solutions, a user is generally presented at least with the mixing challenge that requires a separate container; decreasing convenience and practicality and adding to the cost.

While materials have continued to evolve, for example, so that they are more resistant to bacteria or to extend shelf life of products, design and practical solutions for a single package to include a main content and at least one separate additive for the main content have been stagnant. For example, most existing package alternatives are not able to enable mixing of controlled amounts of two or more components before dispensing, nor enable user pairing of contents of selected products from complementary packages in a practical and improved manner. Accordingly;

There is a need for a relatively low cost packaging solution that can be used for more than one type of product and is designed to reduce waste materials;

There is a need for packaging that allows a user to mix amounts of two or more separately contained products in a single package prior to dispensing;

There is a need for packaging that enables a reduction of shelf space without decreasing the options available to the consumer;

There is a need for packaging for an additive receptacle that can be incorporated into a container as to reduce overall footprint and enable practical and controlled addition/mixing; and There is a need to consolidate a product and one or more additive to the product packages into separate but complementary packages.

Accordingly, improved practical disposable configurable packages that can be easily and relatively inexpensively manufactured and overcome the aforementioned needs are desired.

SUMMARY OF THE INVENTION

The foregoing needs are met, to a great extent, by the present invention, wherein in some aspects of embodiments of the invention are intended to address one or more of the above noted fundamental problems associated with existing packaging and container solutions. The improved cap for controllable mixing and dispensing of products, for example, allowing a user to mix/pair controlled amounts of one or more additive from a complementary receptacle that can be or is integrated into a product container for mixing with the contents of the product container in a practical way and prior to dispensing.

According to some aspects of the disclosure, a disposable cap having a receptacle for a container is disclosed. The disposable cap including a top rigid portion connected to cap rigid sidewalls having an outer portion and an inner portion, and the inner portion of the rigid sidewalls including a cap coupling structure; a receptacle having receptacle sidewalls having an outer portion and an inner portion and extending from the top rigid portion of the cap to a bottom portion; and a channel formed between the inner portion of the cap rigid sidewalls and the outer portion of the receptacle sidewalls. In accordance with some embodiments, the cap coupling structure can be contained in the channel between the inner portion of the cap rigid sidewalls and the outer portion of the receptacle sidewalls and the channel can be configured as to allow at least a portion of a container coupling structure to be inserted therein and interact with the caps coupling structure. The receptacle can be configured to contain an additive that can be added to the container for mixing with the contents of the container while the disposable cap is fixed to the container.

In accordance with some embodiments, the rigid sidewalls of the cap are tubular and the cap coupling structure includes thread along the inner portion of the rigid sidewalls as to enable the screwing of the container coupling structure thereon. A breachable pre-perforated portion on the bottom portion of the cap may also be included. The pre-perforated portion on the bottom portion of the cap may be defined by a plastic insert which may also be configured to prevent contents from the container from being transferred into the receptacle and/or dispensing controlled amounts of the additive in the receptacle into the contents of the container. Other optional aspects may also include a puncturing structure along the lower rigid sidewalls of the cap configured to breach a seal of the container upon matting of the cap coupling structure and the container coupling structure and/or a locking feature along the bottom portion of the sidewalls of the cap configured to prevent engagement of the cap coupling structure and the container coupling structure past a level that results in the breaching of the pre-perforated portion without disengagement of the locking feature. In some embodiments, a portion of the top of the cap can also be configured to be pressed as to enable the breaching of the receptacle and dispensing of at least a portion of the additive into the container. Alternatively or in addition to, in some embodiments, at least a portion of the inner rigid sidewalls of the cap can include a container coupling structure abutting offset configured to press the sidewalls of the receptacle when the cap coupling structure is engaged with the container coupling structure over a predetermined level.

In accordance with additional aspects of the disclosure, a disposable cap system having a receptacle containing an additive to be dispensed onto contents of a container includes a cap and an adaptor. The cap including a top rigid portion connected to cap rigid sidewalls having an outer portion and an inner portion; the inner portion of the rigid sidewalls including a cap coupling structure; a receptacle having receptacle sidewalls having an outer portion and an inner portion and extending from the top rigid portion of the cap to a bottom portion; a channel formed between the inner portion of the cap rigid sidewalls and the outer portion of the receptacle sidewalls, and the adaptor including an adaptor coupling structure to be inserted into the channel and interact with the cap coupling structure; a container coupling structure configured to fix the adaptor onto a surface or opening of the container. The cap coupling structure may be in the channel between the inner portion of the cap rigid sidewalls and the outer portion of the receptacle sidewalls, and the receptacle may be configured to contain an additive that can be added to the container for mixing with the contents of the container after the container coupling structure is fixed to the container.

In some embodiments, the rigid sidewalls of the cap can be tubular and the cap coupling structure includes thread along the inner portion of the rigid sidewalls as to enable the screwing of the adaptor coupling structure thereon. The cap of the disposable cap system can include a breachable pre-perforated portion on the bottom portion of the cap. In some embodiments, a plastic insert positioned to define the breachable pre-perforated portion on the bottom portion of the cap and configured to prevent contents from the container from being transferred into the receptacle. The plastic insert can enable controlled dispensing of the additive in the receptacle into the contents of the container.

An optional puncturing structure configured to breach a seal of the container upon fixing of the adaptor onto the container structure may also be included. For example, a portion of the top of the cap can be configured to be pressed as to enable the breaching of at least a portion of the receptacle and dispensing of at least a portion of the additive into the container. Alternatively or in addition to, in some embodiments at least a portion of the inner rigid sidewalls of the cap can include an adaptor coupling structure abutting offset configured to press the sidewalls of the receptacle when the cap coupling structure is engaged with the adaptor coupling structure over a predetermined level. In yet additional embodiments, the container coupling feature includes an adhesive film that can be affixed to a plastic bag container.

In accordance with yet additional aspects, a disposable cap having a receptacle for a container is disclosed. The disposable cap including: a top rigid portion connected to cap rigid tubular sidewalls having an outer portion and an inner portion; the inner portion of the rigid tubular sidewalls including a cap threaded coupling structure; a receptacle having receptacle sidewalls having an outer portion and an inner portion and extending from the top rigid portion of the cap to a bottom portion having a pre-perforated slit; and a channel formed between the inner portion of the cap rigid tubular sidewalls and the outer portion of the receptacle sidewalls, wherein the cap coupling structure is contained in the channel between the inner portion of the cap sidewalls and the outer portion of the rigid receptacle tubular sidewalls, the channel is configured as to allow at least a portion of a container coupling structure to be inserted therein and screw into the caps coupling threaded structure, and wherein the receptacle is configured to contain an additive that can be added to the container for mixing with the contents of the container while the disposable cap is fixed to the container.

A more detailed explanation of the invention and aspects thereof is provided in the following detailed descriptions and appended claims taken in conjunction with the accompanying drawings.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. Reference will now be made to the accompanying drawings, which are not necessarily drawn to scale. Like reference numerals may indicate corresponding parts in various drawings. Without limiting the range of possible configurations, the foregoing and other features or aspects of the present disclosure will be more readily apparent from the following detailed description and drawings of exemplary illustrative embodiments of the in invention in which.

Figure 1:
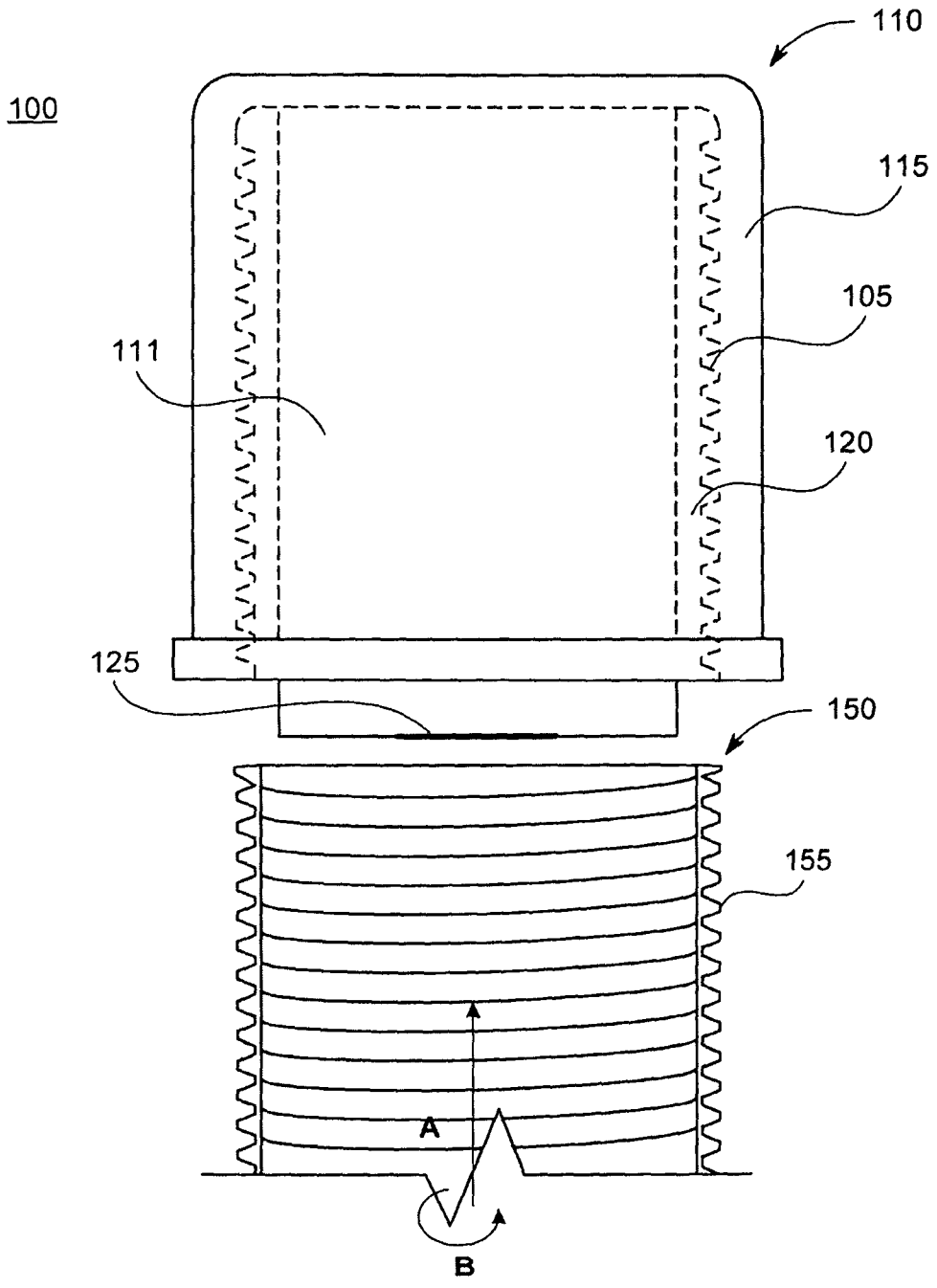
FIG. 1 is a side view of an exemplary container cap system according to aspects of the disclosure.

The present invention is further described in the detailed description that follows.

DETAILED DESCRIPTION

Going forward, various aspects of the configurable packet of the present disclosure may be illustrated by describing components that are coupled, attached, and/or joined together. As used herein, the terms "bonded", "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of the steering device in addition to the orientation depicted in the drawings. By way of example, if aspects of the container cap system shown in the drawings are turned over, elements described as being on the "bottom" side of the other elements would then be oriented on the "top" side of the other elements. The term "bottom" can therefore encompass both an orientation of "bottom" and "top" depending on the particular orientation.

Various aspects of the container cap system may be illustrated with reference to one or more exemplary embodiments. As used herein, the term "exemplary" means "serving as an example, instance, or illustration," and should not necessarily be construed as preferred or advantageous over other embodiments of the container cap system or assembly disclosed herein.

Glossary

In this description and claims directed to the disclosure, various terms may be used for which the following definitions will apply:

"Additive", as used herein, can refer to a compound, substance, topping, reactant, colorant, enhancer or modifier which may be added to a container's contents. In the food packaging field, by way of non-limiting example, additives may be condiments or supplements and can include wet/dry edible products that are individually packaged for a consumer to add to food/drink.

"Container", as used herein, can refer to a flexible or rigid container having or being adaptable to include a rigid connector configured to mate with another corresponding connector of a cap. Containers may include, for example, bottles, plastic bags, paper containers, or any combination of the such.

"Controllable dispensing", as used herein, can refer to dispensing from the container subsequent to the additive from the cap's receptacle being mixed with the contents of the container.

"Controllable mixing", as used herein, can refer to the mixing of all or variable amounts (as per user preference) of the additive with the contents of the container without transferring/removing either the additive or the contents from the container or removing the cap.

"Pre-perforated", as use herein, can refer to small indentations or micro sized holes made to pre-defined portions one or more of the walls of the cap's compartment as to enable a user to easily create an outlet for dispensing of the additive into the container.

"Re-enforcement strip(s)", as used herein, can refer to one or more strips of material added near the pre-perforated sections to prevent rupture or expansion of the tear past the pre-perforated sections.

"Exterior walls", as used herein, refers to rigid/non-rigid (e.g., polyethylene, polyvinylidene chloride, homopolymer of vinylidene chloride, aluminum laminated plastics, etc.) walls facing towards the outside of the container or cap.

"Breach", "Tear", "break", or "open", as used herein with respect to the bottom portion of the receptacle and in the container, can refer to an action by the user to communicate the receptacle to the inside of the container.

"Valve", as used herein, can refer to a plastic insert used to control the flow of an additive from the receptacle in/out of the container. In some embodiments, the plastic insert can serve as a one-way valve that can be opened via manual manipulation of the user in order to allow the flow of additive into the container.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as one skilled in the art would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law.

Referring to FIG. 1, a side view of an exemplary container cap system 100 according to aspects of the disclosure is shown. The container cap system 100 including a cap 110 having rigid sidewalls 115 enclosing at least part of a receptacle 111 containing an additive (not shown). Along at least a portion of the inside of the rigid walls 115 of the cap 110 can be a coupling structure 105. The coupling structure 105 may be a threaded fastening feature. In other embodiments, the coupling structure may, alternatively or in addition to, include clasps, latches, fastening protrusions and the such. In accordance with some aspects of the disclosure, a channel 120 between the receptacle 111 and the rigid sidewalls 115 can be adapted for a container's coupling structure 150 including complementary threads 155 to fit and therein. As shown in the present embodiment, by rotating motion B of the cap 110 in relation to the container coupling structure 150, the cap 110 can travel along A to secure itself providing a seal to both the container's contents (not shown) and the receptacle 111. A bottom portion of the receptacle 111 may include an insert 125 defining pre-perforated slits that can be used for the user to apply pressure to the cap and cause the rupturing of the pre-perforated slits and transfer of the additive onto the container before having to transfer either the contents of the container or the additive out of the package.

In accordance with some embodiments, the cap 110 may be designed as to fit the threads of a standard container bottle. In alternative embodiments, some of which are described in relation to FIGS. 3 and 4, for example, the container (not shown) may be a bag, carton, package/box, or the such. The plastic insert 125 may optionally act as a one way valve that can control one or both of the quantity of the additive being dispensed when pressure is applied to the cap 110 or the flow of the additive. The cap 110 including the receptacle 111 can vary in volume and/or type and amount of additive offered and may be offered as a replacement cap (to the original of a standard container). Additives can also vary in concentration or form (i.e. solid, liquid, gas) depending on the application and product field.

Figure 2A:
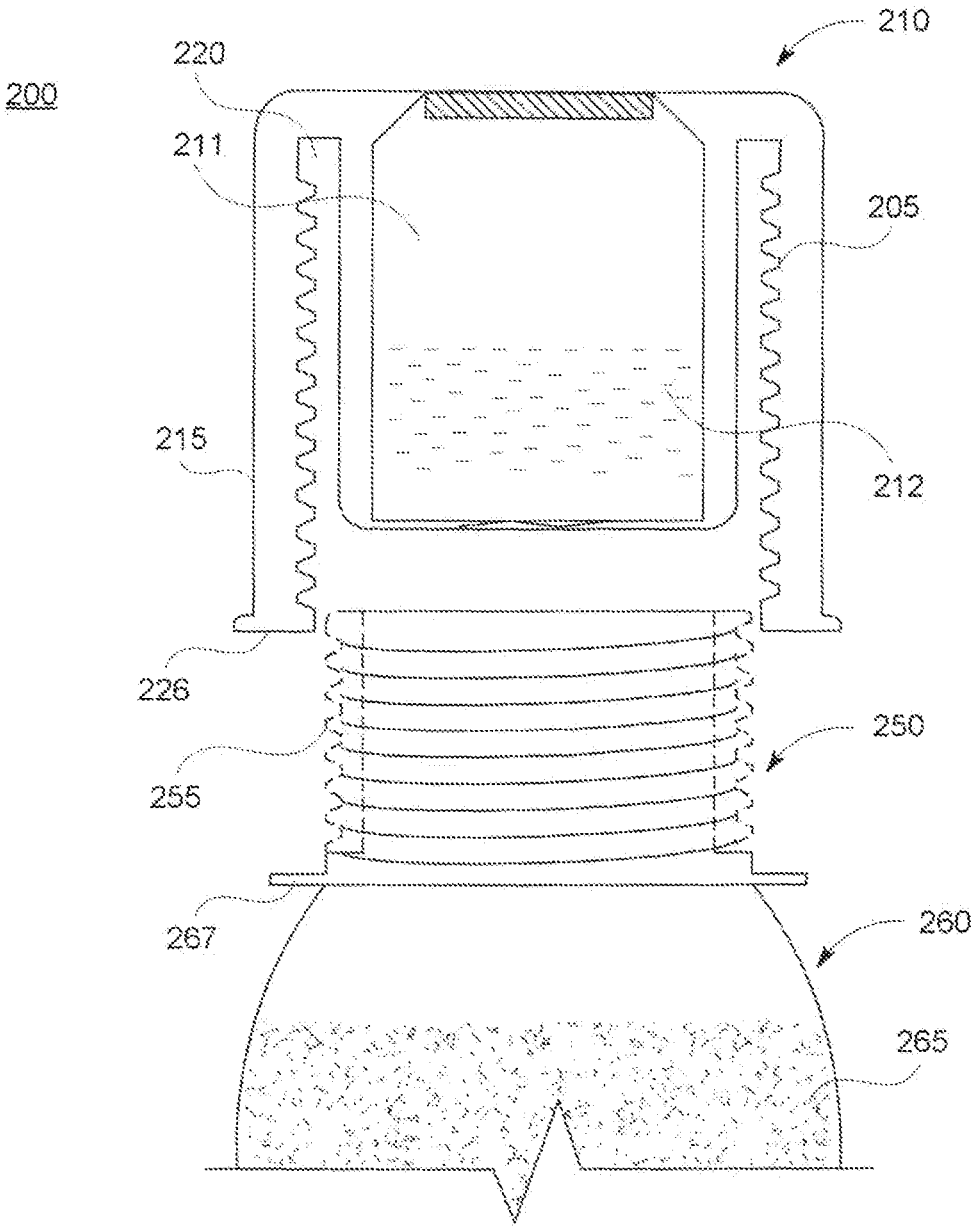
FIG. 2A is a side view of another exemplary container cap system according to additional aspects of the disclosure.
Figure 2B:
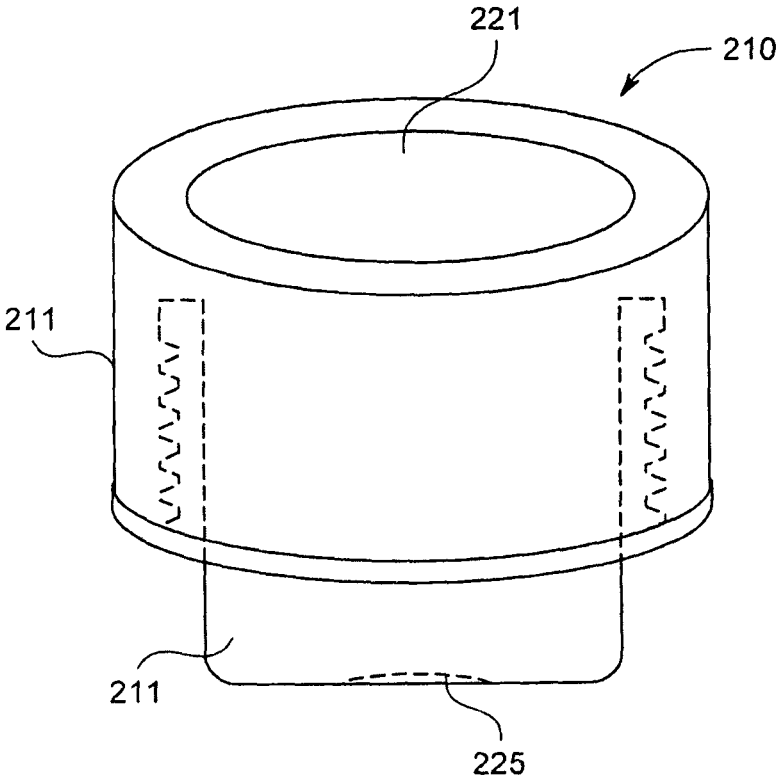
FIG. 2B is a perspective view of the cap of the exemplary container cap system of FIG. 2A.

Referring now to FIGS. 2A and 2B, a side view of another exemplary container cap system 200 and a perspective view of the cap 210 are shown respectively.

In accordance with some embodiments, cap container system 200 includes a cap 210 that includes an integrated receptacle 211 using vertical rigid walls 215 along the outside perimeter and also forming the receptacle 211. A cap coupling structure 205 is also included along a channel between the inside of the walls 215 and the receptacle 211. The top portion of the cap 210 may include a semi-rigid or elastic film region 211 to enable a user to easily apply controlled pressure onto the receptacle 211 and dispense the additives 212 therein onto the container 260 in a controlled manner. In some embodiments, for controlled dispensing, the receptacle 211 containing the additives may be pressurized during packaging of the additive 212. A pre-perforated slid 225 may also be included along a portion of the receptacle 211 to facilitate dispensing. Cap coupling structure 205 equally can complement a container's coupling structure's 250 threads 255, for example. In some embodiments, a cap locking protrusion or stop 226 can interact with a container locking protrusion or stop 267 as a means to practically lock, childproof it, or secure it, without causing damage to the cap 211 or container 260. Once the cap 211 is inserted into the container 265, the additive 212 can be dispensed onto a container's contents 265 for mixing inside of the container 260 and before dispensing.

Figure 3:
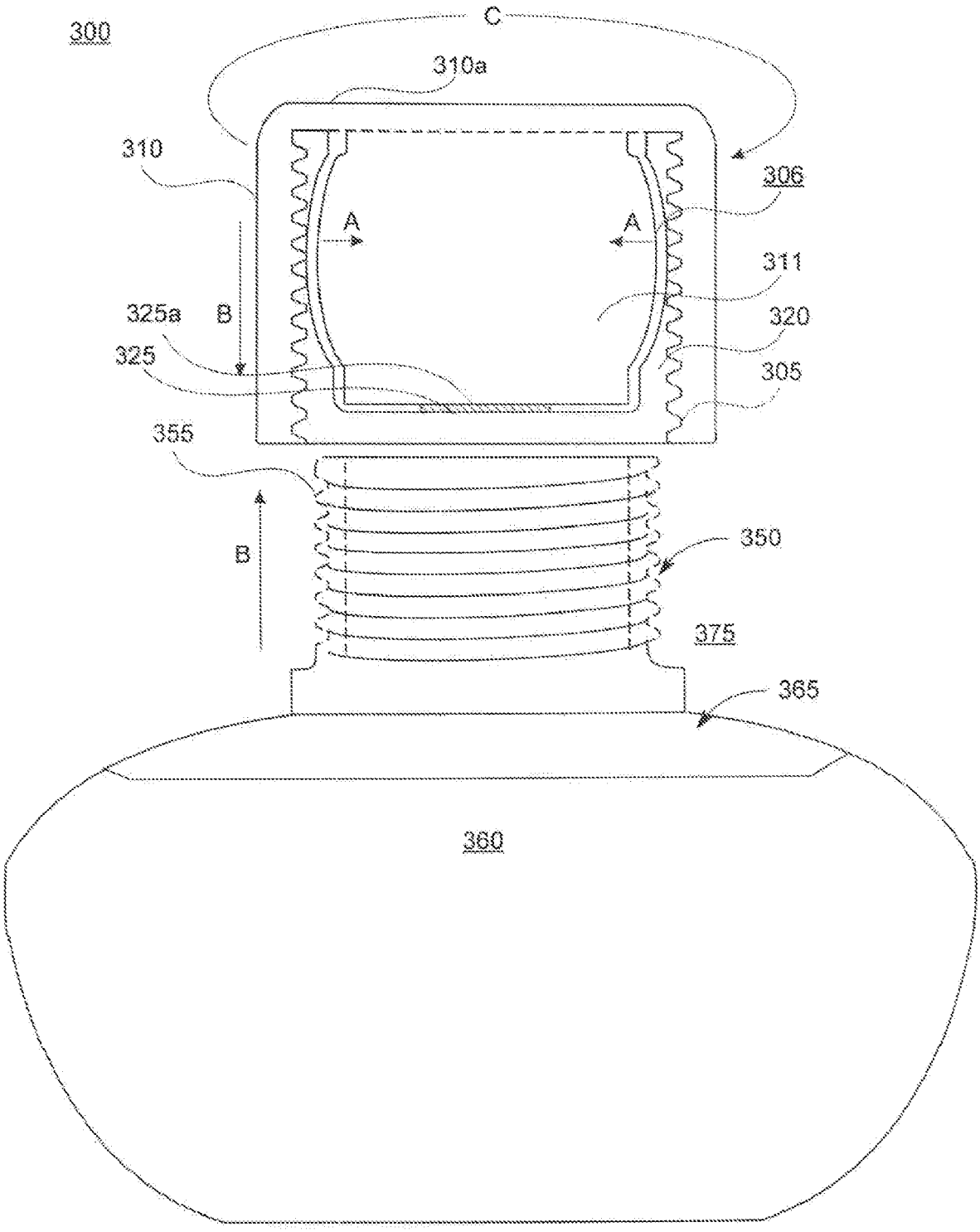
FIG. 3 is a side view of yet another exemplary container cap system according to additional aspects of the disclosure.

Referring now to FIG. 3, a side view of yet another exemplary container cap system 300 according to additional aspects of the disclosure is shown. In accordance with some aspects of the disclosure, the container cap system can include an adaptor 375, for example, when the container 360 may be a plastic bag with sealed contents therein. The adaptor 375 can include an adhesive film 365 which may be tapped or fixed onto a surface of the bag as to provide a means to engage the cap 310. The cap can include a plastic insert 325.

In some embodiments, receptacle 311 compression walls 306 can be included to apply pressure to the volume of the receptacle a shown in A when the adaptor's coupling structure 350 travels in the direction of B, for example, as a result of rotation C engaging the threads of the cap 305 onto the coupling structures coupling structure or threads 355. The cap 310 of the container cap system 300 may additionally or alternatively include a container coupling structure abutting offset (not shown) configured to press the sidewalls of the receptacle similarly when the cap coupling structure is engaged with the container coupling structure over a predetermined level inside the channel 320.

Figure 4:
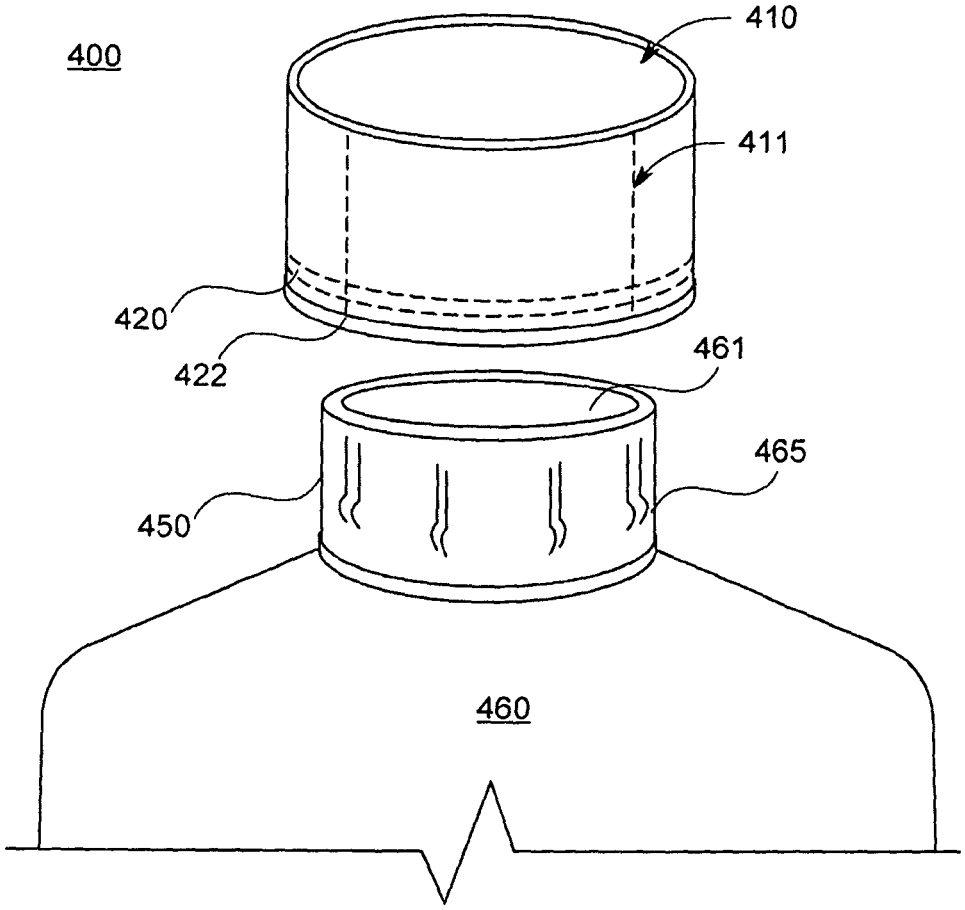
FIG. 4 is a perspective view of yet another exemplary container cap system according to aspects of the disclosure.

Referring now to FIG. 4, a perspective view of yet another exemplary container cap system 400 according to aspects of the disclosure is shown. In accordance with some embodiments, the container cap system 400 includes a sealed container 460 including a coupling structure 450 having a seal 461 and coupling fastening clips 465. The seal 461 may be a breachable aluminum film or the such and breachable. The cap 410 includes, in addition to the complementary to the fastening clips 465 cap fastening structure 420, a puncturing structure 422 at the bottom of the receptacle 411 to enable the breaching of the seal 461. A puncturing structure may be any sharp or pointed structure capable of breaching the seal 461 when a user presses down and/or rotates the cap 410 onto the container 460.

Conclusion

In accordance with aspects of the disclosure, as described above and as further defined by the claims below, by enabling a container cap system for controlled mixing and dispensing, and incorporating caps having receptacles of different volumes, configurations, and being complementary to a container or an adaptor for a container, a user may select both predetermined quantities or type of additive according to his/her own preferences. Inventory can be controlled by a retailer in accordance with consumption or shelf life of the additive and the container product separately. Also, shelf space can be controlled according to consumption but without limiting the options available to the consumer.

It is claimed:

1. A disposable cap system having a receptacle containing an additive to be dispensed onto contents of a container, the disposable cap system comprising:

a cap having:

a top rigid portion connected to cap rigid sidewalls having an outer portion and an inner portion;

the inner portion of the rigid sidewalls including a cap coupling structure;

a receptacle having receptacle sidewalls having an outer portion and an inner portion and extending from the rigid portion of the cap to a bottom portion;

a channel formed between the inner portion of the cap rigid sidewalls and the outer portion of the receptacle sidewalls; and an adaptor having:

an adaptor coupling structure to be inserted into the channel and interact with the cap coupling structure;

a container coupling structure configured to fix the adaptor onto a surface or opening of the container;

wherein the cap coupling structure is in the channel between the inner portion of the cap rigid sidewalls and the outer portion of the receptacle sidewalls, wherein the receptacle is configured to contain an additive that can be added to the container for mixing with the contents of the container after the container coupling structure is fixed to the container, and wherein the container coupling feature includes an adhesive film that can be affixed to a plastic bag container.

2. The disposable cap system of claim 1, wherein the rigid sidewalls of the cap are tubular and the cap coupling structure includes thread along the inner portion of the rigid sidewalls as to enable the screwing of the adaptor coupling structure thereon.

3. The cap of the disposable cap system of claim 1, additionally comprising:

a breachable pre-perforated portion on the bottom of the receptacle.

4. The cap of the disposable cap of claim 3, additionally comprising:

a plastic insert positioned to define the breachable pre-perforated portion on the bottom of the receptacle and configured to prevent contents from the container from being transferred into the receptacle.

5. The cap of the disposable cap system of claim 4, wherein the plastic insert enables controlled dispensing of the additive in the receptacle into the contents of the container.

6. The disposable cap system of claim 1, wherein a portion of the top of the cap is configured to be pressed as to enable the breaching of at least a portion of the receptacle and dispensing of at least a portion of the additive into the container.

7. The disposable cap system of claim 1, wherein at least a portion of the inner rigid sidewalls of the cap include an adaptor coupling structure abutting offset configured to press the sidewalls of the receptacle when the cap coupling structure is engaged with the adaptor coupling structure over a predetermined level.

* * * * *